US005158417A

United States Patent [19]

Siegenthaler et al.

[11] Patent Number: 5,158,417

[45] Date of Patent: Oct. 27, 1992

[54] GRIPPING AND MANIPULATING MEANS FOR RECEPTACLES OF TEXTILE MATERIAL

[75] Inventors: Marcel Siegenthaler, Effretikon; Niklaus Gartenmann, Winterthur, both of Switzerland

[73] Assignee: Maschinenfabrik Rieter AG, Winterthur, Switzerland

[21] Appl. No.: 610,005

[22] Filed: Nov. 7, 1990

[30] Foreign Application Priority Data

Nov. 7, 1989 [CH] Switzerland ..... 4013/89

[51] Int. Cl.[5] ..... B60P 1/48

[52] U.S. Cl. ..... 414/539; 57/281; 294/115; 294/902; 294/907; 414/543; 414/744.5; 901/1; 901/41

[58] Field of Search ..... 414/539-543, 414/618, 621, 626, 744.5; 57/22, 90, 261, 281; 294/115, 90, 902, 907; 901/1, 15, 33, 41

[56] References Cited

U.S. PATENT DOCUMENTS

| | | | |
|---|---|---|---|
| 78,566 | 6/1868 | Barker | 414/540 |
| 3,194,422 | 7/1965 | Shinn, Jr. | 414/621 |
| 3,223,267 | 12/1965 | Stammer | 414/621 X |
| 3,904,234 | 9/1975 | Hill et al. | 294/902 X |
| 4,273,506 | 6/1981 | Thomson et al. | 901/33 X |
| 4,650,235 | 3/1987 | Shaginian et al. | 294/90 X |
| 4,764,078 | 8/1988 | Neri | 901/1 X |
| 4,859,139 | 8/1989 | Torii et al. | 414/744.5 |
| 4,939,895 | 7/1990 | Raasch et al. | 57/281 X |
| 4,956,969 | 9/1990 | Raasch | 57/281 |
| 4,994,970 | 2/1991 | Noji et al. | 901/1 X |

FOREIGN PATENT DOCUMENTS

| | | | |
|---|---|---|---|
| 2326950 | 12/1974 | Fed. Rep. of Germany . | |
| 3440598 | 5/1986 | Fed. Rep. of Germany . | |
| 3501875 | 7/1986 | Fed. Rep. of Germany . | |
| 3519299 | 12/1986 | Fed. Rep. of Germany | 414/540 |
| 3524922 | 1/1987 | Fed. Rep. of Germany . | |
| 8525743 | 4/1987 | Fed. Rep. of Germany . | |
| 3618857 | 12/1987 | Fed. Rep. of Germany . | |
| 1426753 | 12/1965 | France | 414/621 |
| 2443993 | 7/1980 | France . | |
| 841962 | 7/1981 | U.S.S.R. | 294/907 |

*Primary Examiner*—David A. Bucci
*Attorney, Agent, or Firm*—Dority & Manning

[57] ABSTRACT

A gripping and manipulating apparatus is mounted on a conveying vehicle and comprises an articulated arm and gripping member. The gripping member is disposed at the moving end of the articulated arms and comprises a multi-element lazy-tongs mechanism having two receptacle retainers. The movement of the retainers is produced by a drive element, a part thereof acting on guide elements. The guide elements are pivotally connected to the retainers. The gripping member can fold down to a reduced dimension and its three pivots lead to a compact construction for the conveying vehicle. Also, a securing device is included for securing the end of a band or sheet or the like of textile material and is disposed on the articulated arm or on the gripping member and is movable therewith. The space required between the vehicle and the textile machines and between the individual receptacles is reduced.

2 Claims, 3 Drawing Sheets

GRIPPING AND MANIPULATING MEANS FOR RECEPTACLES OF TEXTILE MATERIAL

BACKGROUND OF THE INVENTION

The invention relates to gripping and manipulating means for receptacles of textile material on textile machines. This means comprises a conveying vehicle for the receptacles and the gripping means is part of a manipulator and has retainers for the receptacles.

German Patent Publication DE 3 440 598 A1 describes means for conveying receptacles of textile material which in this case are sliver cans. The conveying means form part of a spinning machine having a number of spinning stations. The conveying means takes the form of a movable truck or trolley or the like on which two extendable articulated arms are disposed. The arms have two articulations and each arm has tongs-like means for receiving the receptacles or cans. The tongs-like means are embodied by a rigid half-shell extending approximately half way round the periphery of a circular sliver can. The tongs-like means have corresponding clamping elements. The vehicle with the two articulated arms is relatively clumsy and requires a relatively large amount of free space between the textile machines (to be approached) and the receptacle places on the spinning machines; otherwise the receptacles cannot be pivoted out of the spinning machine and moved by the truck. Another disadvantage of this device is that during the movement of the conveying means the receptacles or cans must be carried by the tongs-like receiving means on the articulated arms—i.e., by the arms themselves.

It is also known for the top edge of the receptacles to be engaged somewhere by clamping means, having additional support means which contact the generated or envelope surface of the receptacle to prevent tilting. Means of this kind may damage the latter surface and it is difficult to position and, more particularly, to turn the receptacles around their axis.

SUMMARY OF THE INVENTION

The object of the invention is to provide gripping and manipulating means for receptacles of textile material which require very little free space for receptacles changing and facilitates the construction of a compact conveying vehicle.

It is another object of the invention to enable the receptacles to be engaged without additional supports for the envelope or generated surface and to reduce the intermediate space required between the receptacles.

The construction according to the invention enables the conveying vehicle to be of compact construction since the gripping means can be folded down into a restricted space, more particularly because of the multi-element lazy-tongs mechanism used with two receptacle retainers. The tongs facilitate entry into narrow gaps between adjacent receptacles and enable the receptacles to be moved out of their position in a straight vertical line. Gaps between individual receptacles can, therefore, be very small, with a consequent saving of ancillary surfaces on the textile machines. The tongs means can engage individual receptacles which are positioned very close together. Since the means enable the receptacles to be held near their cross-sectional axis—i.e., the plane containing the center of gravity—no further means are needed to prevent tilting or pivoting of the receptacle. The inclined contact surfaces of the support ledges of the receptacle retainers and the edge of the receptacles and the receptacle is engaged self-adjustingly. This form of engagement is very simple and reliable and requires reduced adjusting forces. Also, the gripping means according to the invention enable the receptacles to be rotated and positioned around their own axis in a relatively wide zone. The driving element driving the two pairs of guide elements associated with each receptacle retainer can be embodied in various known ways. The use of guided drive bars or of a geared drive is very advantageous.

The articulated arm is mounted on a vertical column secured to the conveying vehicle and leads to further convenient solutions of the space problem. To suit space requirements the vertical column is either disposed vertically between two receptacle supports on the conveying vehicle or suspended on a gantry frame. When the means are required to handle textile material, securing means are disposed on the gripping means or on the articulated arm and enable the end of a textile material, for example, of a textile band or sheet or the like, to be positioned and secured in the operative position necessary for the textile machine. Since the means for securing the textile material are disposed directly on the gripping means or on the articulated arm and are rotatable with the gripping means, the end of the material is secured accurately and no additional means are needed to search for and secure the end of the material at the working stations of the textile machine. Receptacle changing in textile machines is therefore considerably simplified and the course of the operation is improved.

Even when all the conveying supports for the receptacles on the conveying vehicle are occupied, the gripping and manipulating means according to the invention can be moved and brought to a different position relative to the receptacle. The gripping means are also disposed in their entirety near the conveying vehicle during the displacement thereof, and so no additional free space is needed for their movements. The conveying vehicle can, therefore, move very close to the textile machines, thus saving the space necessary for a vehicle lane.

BRIEF DESCRIPTION OF THE DRAWINGS

The invention will be described in greater detail hereinafter with reference to the drawings which illustrate embodiments of the invention, and in which.

DETAILED DESCRIPTION OF THE INVENTION

Figure 1:
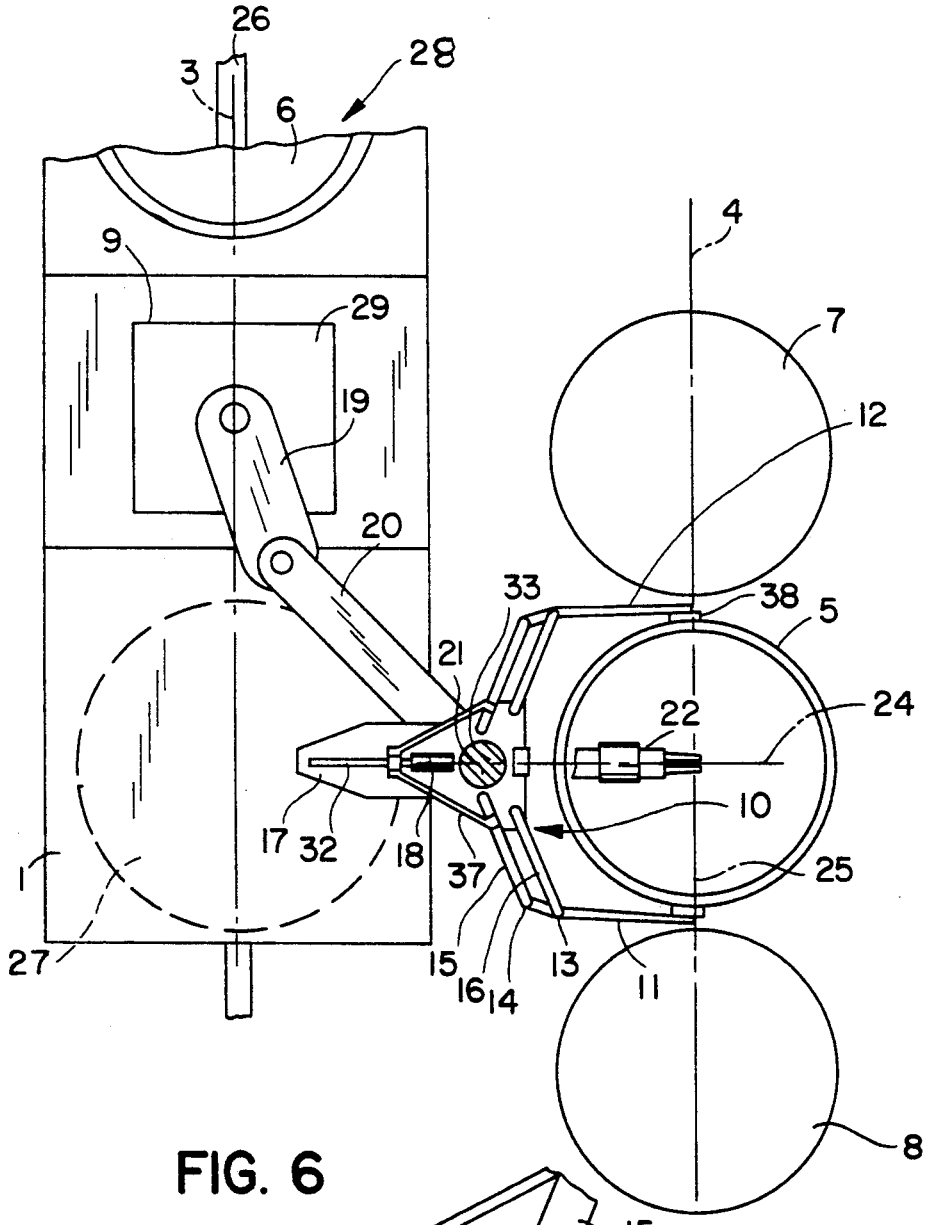
FIG. 1 is a diagrammatic plan view of a conveying vehicle having gripping means and an articulated arm according to the invention.
Figure 2:
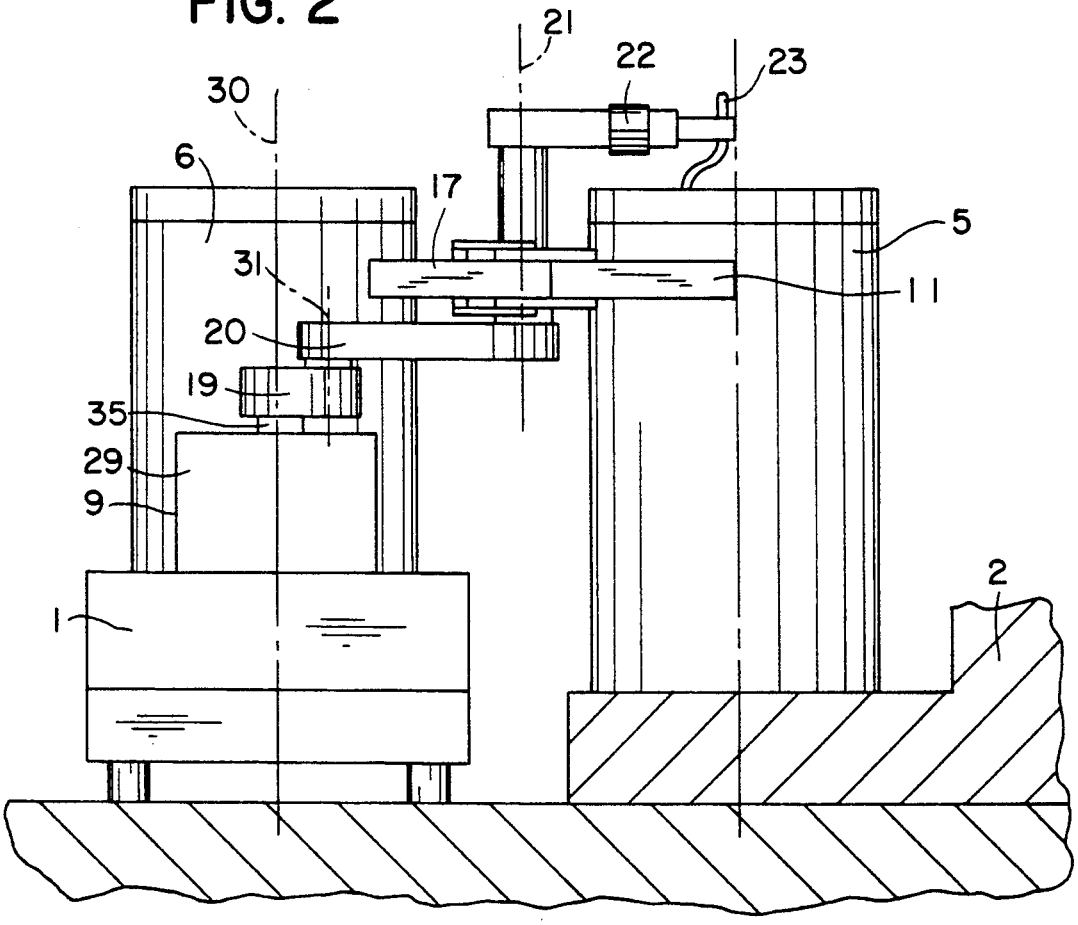
FIG. 2 is a front elevation of the conveying vehicle and also shows part of a textile machine being serviced.

FIGS. 1 and 2 show a conveying vehicle 1 movable along a movement axis 3 on a track 26. Vehicle 1 has two places or supports 27, 28 for the conveyance of receptacles 5, 6 of textile material. Disposed between the two places where 27 and 28 is a manipulator 9 comprising a driving and lifting unit 29, a vertical column 35, an articulated arm comprising a first part 19 and a second part 20 and gripping means 10. The arms 19, 20 have pivots 30, 31, 21. The gripping means 10 are mounted on the pivot 21 and means 22 for securing a textile band or sheet or the like 23 are disposed above the gripping means 10 on pivot 21. The securing means 22 comprise a known clamping and locating facility for the ends of textile bands or sheets or the like and are moved and positioned together with the gripping means 10 by means of the arm parts 19, 20.

The gripping means 10 comprises a multi-element lazy-tongs mechanism having two receptacle retainers 11, 12. Each of the lazy-tongs have in their rearward zone (in the example shown) a folding point 13 and are inclined towards the pivot 21. Guide elements 15, 16 are mounted at a rearward end 14 and at the folding point 13 of each retainer 11, 12. The guide elements 15, 16 are of the same length as one another and are mounted at their other end on a baseplate 17. The two guide elements 15, 16 form a parallelogram and are, in a known manner, designed so that the retainers 11, 12 perform the required movements to reach the gripping position.

Figure 6:
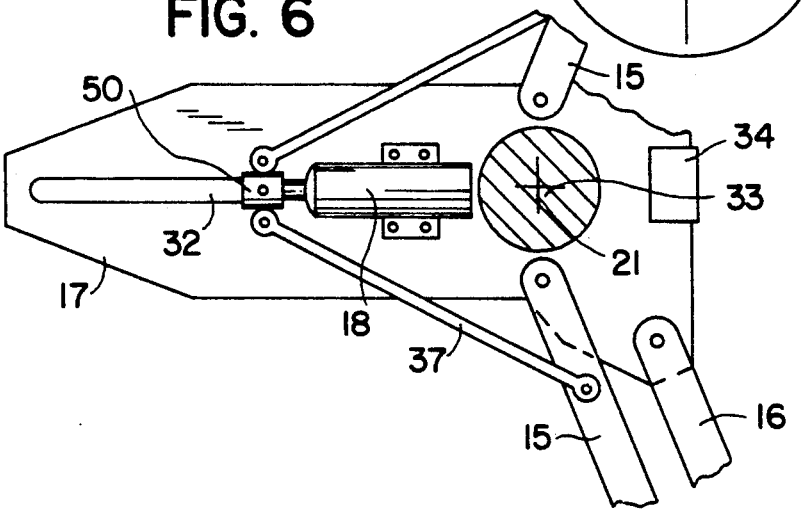
FIG. 6 is an enlarged plan view of the lazy tongs linkage of FIG. 1.

As seen in more detail in FIG. 6, guide elements 15 and 16 for each of retainers 11 and 12, respectively are pivotably connected to baseplate 17. Guide element 15, in each case, is also pivotably connected to a drive rod 37. The other ends of drive rod 37 is pivotably connected to a guide element 50 which moves in guide slot 32 on baseplate 17. Guide element 50 is mounted to be reciprocated in slot 32 by the piston rod of a linear motor 18, which is fixed to baseplate 17.

Depending upon the required movement pattern the guide elements 15, 16 may differ in length from one another, in which event they do not extend parallel to one another in every position. The retainers 11, 12 and guide elements 15, 16 are moved by means of a drive motor 18 (two drive rods 37 in the embodiment shown) which are connected to the guide elements 15 and are mounted in a guide slot 32 in the baseplate 17. The drive motor 18, can in a known manner, be embodied by a geared drive comprising a toothed rack, a toothed belt, or a worm wheel. The length of the retainers 11, 12 is such that they engage the receptacle 5 somewhere near its cross-sectional axis 25, intersecting the vertical central axis of the receptacle 5. The cross-sectional axis 25 corresponds to a horizontal axis which extends in the vertical plane containing the center of gravity of the receptacle—i.e., the receptacle can be raised or lowered vertically without tilting.

Inside the textile machine 2, for example, a spinning machine, a number of receptacles 5, 7, 8 for textile material are lined up along an axis 4 which is the same as axis 25 when the receptacles are in place. During the operation of the machine 2 empty receptacles 5, 7, 8 must be exchanged for full receptacles. In other textile material treatment processes full receptacles must be exchanged for empty receptacles, something which can of course be effected in the same way by the device according to the invention.

Figure 3:
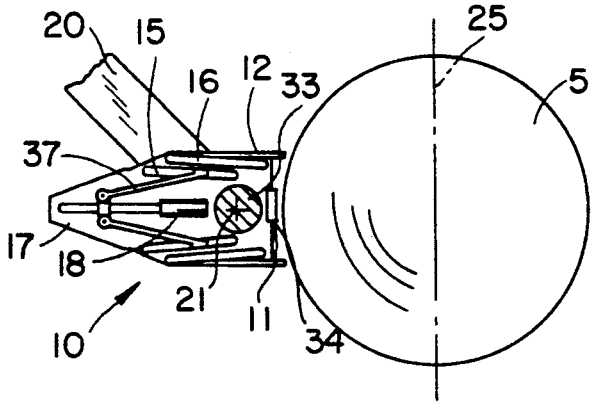
FIG. 3 is a plan view of the gripping means in the standby position.

In FIG. 3 the gripping means 1, which are shown in the gripping position in FIG. 1, are shown in the standby or waiting position. In this position the two retainers 11, 12 have been withdrawn to near the pivot 21 and engaged with the baseplate 17. Only a reduced gap is needed between the pivot 21 and the generated or envelope surface of the receptacle 5 since most of the gripping means 10 are disposed when in the standby position on the opposite sides of the pivot 21. When in this standby position the gripping means 21 can readily be moved along the envelope of a receptacle 5 and, in the required gripping position, the retainers 11, 12 can be extended and engage the generated or envelope surface of the receptacle 5. To this end, the baseplate 17 is pivotable around its pivot 21, which is positioned by means of the two arm parts 19, 20 and by pivoting around the pivots 30, 31. Disposed on the baseplate 17 is a sensor 34 which ascertains the distance between the gripping means 10 and the wall of the receptacle 5. By means of the sensor 34 the gripping means 10 are moved into and stopped at the correct gripping.

In an exchange of receptacles, control means (not shown) move the vehicle 1 into (and secures it in) the correct position before the receptacle 5. First, an empty receptacle 6 is removed from the axis 4 and placed in place 28 of vehicle 1, whereafter the vehicle is moved into a new position and, by means of the manipulator 9 and gripping means 10, a full receptacle 5, in place 27 on vehicle 1, is engaged and moved into the position shown in FIG. 1 on the axis 4. Simultaneously, as the gripping means 10 engage the receptacle 5, the textile securing means 22 engage the end of the sheet or band or the like 23 of textile material and moves it into a position in which it can be transferred to the appropriate transfer means of the textile machine 2. Consequently, simultaneously as the receptacles 5, 6 are changed the textile material in the receptacle 5 is reconnected to the machine 2 so that it is ready to operate. Since the retainers 11, 12 can be introduced between the receptacles 5, 7 or 5, 8 substantially perpendicularly to the axis 4, only a reduced space between the receptacles is necessary. Consequently, parking space along the axis 4 can be saved or more receptacles can be lined up in the space near machine 2. The adjusting movements of the retainers 11, 12 onto the receptacle 5 are monitored and controlled by means of sensors 38 on each of the retainers 11, 12. The distance between the movement axis 3 and the receptacle line axis 4 of the machine 2 is also reduced considerably.

Figure 4:
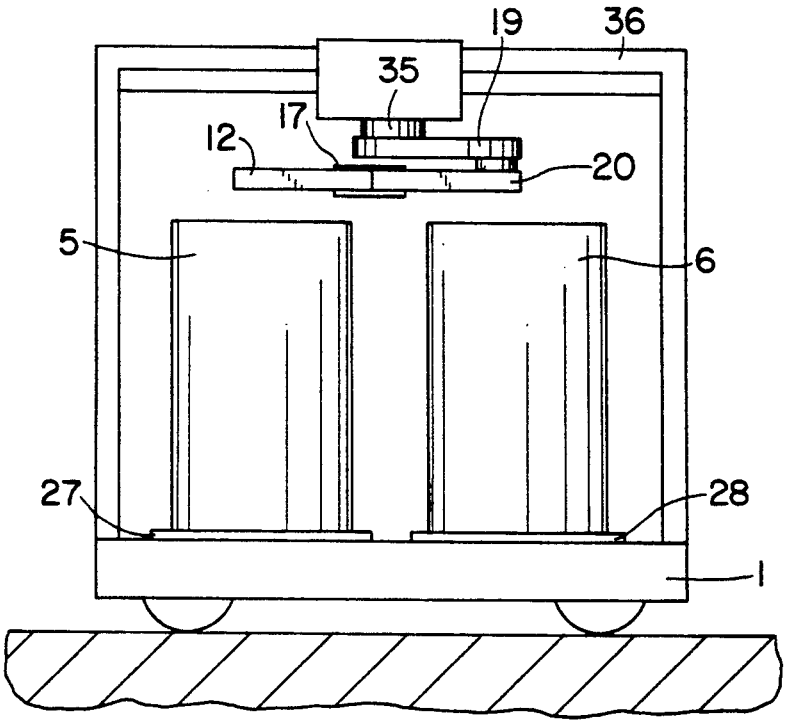
FIG. 4 is a diagrammatic side elevation of another embodiment of the invention having a conveying vehicle with a gantry frame and a suspended gripping means.

The conveying vehicle 1 shown in FIG. 4 has a gantry frame 36 and also has two places 27, 28 for empty and/or full receptacles 5, 6. A vertical column 35, the arms 19, 20, and the gripping means 10 are suspended and mounted on the frame 36 above the receptacles 5, 6. A drive (not shown) is adapted to move the column 35 along the longitudinal axis of the vehicle 1. The vertical column 35 has the lifting elements necessary for lowering or raising the gripping means 10—i.e., the receptacles 5, 6—vertically. In all other respects, this embodiment has the same features as have been described with reference to FIGS. 1 to 3. The vehicle 1 can be shorter and is, therefore, easier to turn.

Figure 5:
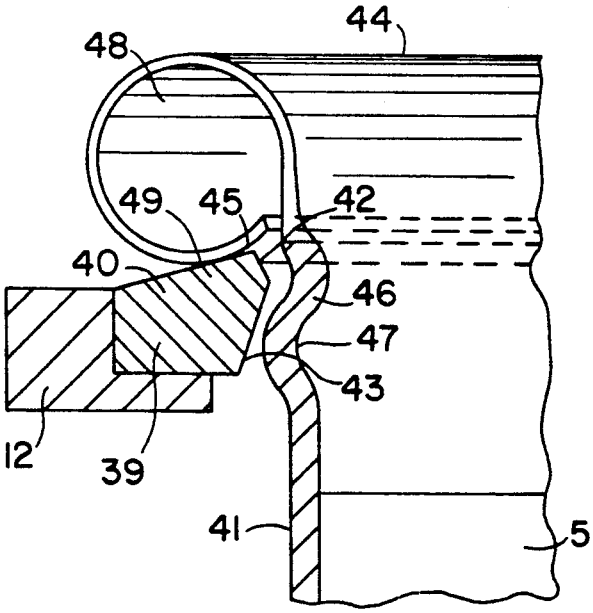
FIG. 5 is a view showing part of the edge of a receptacle with a receptacle retainer.

As shown in FIG. 5, the top edge 44 of the receptacle 5 is specially devised and the gripping means 11, 12 have support ledges 39. Ledges 39 have a top contact surface 40 which inclines outwardly—i.e., it is higher towards the generated or envelope surface 41 of the receptacle 5. On the side near the surface 41 the ledge 39 has two deflecting surfaces 42, 43 having oppositely directed angles to the vertical. In the embodiment shown the surface 42 makes an angle of 30°with a vertical line and the surface 43 makes an angle of 20° with a vertical line. The surface 40 is inclined at 15° to an imaginary horizontal surface. The receptacle edge 44 is formed by double metal sheeting which is rolled inward and forms, rolled-in collar 48, a contact surface 45. The radius of the collar 48 is such that the contact position is disposed in a surface 45 which is inclined outwardly and downwardly or which is curved correspondingly. Top end 46 of the receptacle wall is clamped between the two metal sheets of the edge 44 by means of rolled-in beading 47. The deflecting surfaces 42, 43 enable the retainers 11, 12 to slide over the beading 47 when the retainers 11, 12 are moved from below on to the collar 48. The adjusting and retaining forces required for this embodiment are reduced since the positive engagement between the retainers 11, 12 and the receptacle edge 44 is ensured by the special shaping of these items. Also, the receptacles are protected from damage and the likelihood of defects is reduced.

What is claimed is:

1. Apparatus for replacing receptacles of textile material on textile machines, the receptacles having an outer surface and longitudinal axis, comprising:

(a) a vehicle having means for supporting and conveying a plurality of receptacles alongside and adjacent to a textile machine;

(b) vertical pivot means supported on said vehicle adjacent to said means for supporting said receptacles;

(c) gripping means supported on said vertical pivot means for alternately gripping receptacles on said vehicle and said textile machine when said vehicle is alongside said textile machine, said gripping means comprising two opposed substantially straight retainers having front ends and adapted to extend along opposite sides of said receptacles and for gripping and retaining said receptacles;

(d) means for manipulating said gripping means to move a first receptacle from said textile machine to said vehicle and for replacing said first receptacle with a second receptacle from said vehicle;

(e) control means for controlling said gripping and manipulating means; and (f) means for securing said textile material disposed on said vertical pivot.

2. Apparatus for replacing receptacles of textile material on textile machines, the receptacles having an outer surface and longitudinal axis, comprising:

(a) a vehicle having means for supporting and conveying a plurality of receptacles alongside and adjacent to a textile machine;

(b) vertical pivot means supported on said vehicle adjacent to said means for supporting said receptacles;

(c) gripping means supported on said vertical pivot means for alternately gripping receptacles on said vehicle and said textile machine when said vehicle is alongside said textile machine, said gripping means being mounted on a base plate comprising two opposed substantially straight retainers having front ends and adapted to extend along opposite sides of said receptacles and for gripping and retaining said receptacles;

(d) means for manipulating said gripping means to move a first receptacle from said textile machine to said vehicle and for replacing said first receptacle with a second receptacle from said vehicle;

(e) control means for controlling said gripping and manipulating means; and (f) means for securing said textile material disposed on said vertical pivot, said material securing means mounted on said base plate.

* * * * *